United States Patent [19]

Broemel, Jr.

[11] Patent Number: 4,735,118

[45] Date of Patent: Apr. 5, 1988

[54] AIR RATCHET ADAPTOR

[76] Inventor: Lloyd F. Broemel, Jr., P.O. Box 1086, Denham Springs, La. 70726

[21] Appl. No.: 858,661

[22] Filed: May 2, 1986

[51] Int. Cl.[4] ..... B25B 21/00

[52] U.S. Cl. ..... 81/57.3; 81/57.29; 81/57.13; 81/57.14

[58] Field of Search ..... 81/57.11, 57.3, 57.29, 81/57.13, 57.14, 57.31, 121.1, 125, 124.3, 124.4, 185, DIG. 11, 177.85

[56] References Cited

U.S. PATENT DOCUMENTS

| | | | |
|---|---|---|---|
| 2,806,396 | 9/1957 | Miller | 81/125 |
| 3,027,790 | 4/1962 | Wagner . | |
| 3,069,946 | 12/1962 | Zilliox | 81/185 X |
| 3,532,012 | 10/1970 | Pryor | 81/124.3 X |
| 3,987,692 | 10/1976 | Lesner et al. | 81/57.29 X |
| 4,171,651 | 10/1979 | Dalunto | 81/57.29 |
| 4,287,795 | 9/1981 | Curtiss | 81/57.3 |
| 4,328,720 | 5/1982 | Shiel . | |
| 4,374,479 | 2/1983 | Minotti | 81/57.3 |
| 4,374,480 | 2/1983 | Diaz | 81/57.3 |

FOREIGN PATENT DOCUMENTS

| | | | |
|---|---|---|---|
| 2056348 | 3/1981 | United Kingdom | 81/57.3 |

*Primary Examiner*—Debra Meislin

[57] ABSTRACT

An air ratchet adaptor having a slotted, semicylindrical handle with one end integrally formed into a flat, elongated, rectangular gear housing for transferring powered torque from an air ratchet which is commercially available to the general public in three-eighths inch or other size drive. The air ratchet can quickly and easily be inserted through the opening in the handle and snapped into its proper place. The handle includes the proper handle insert which provides adaptability to many different brands of air ratchets. The gear housing contains a driving gear, meshing idler gears, and a driven gear. The driving gear includes a square aperture for mating engagement with the square shank of the air ratchet head. The driven gear includes a hexagonal aperture to accept internal removable sockets. The internal removable sockets are provided for, to insure that the amount of work space needed to remove and install fasteners is kept to a minimum. The air ratchet adaptor connected with the air ratchet is suitable for installing and removing fasteners, and applying torque to such, in a limited work space wherein a stable, controlled one hand operation of a powered tool is needed.

1 Claim, 2 Drawing Sheets

AIR RATCHET ADAPTOR

BACKGROUND OF THE INVENTION

1. Field of the Invention

This invention relates generally to an extensible adaptor to be used in conjunction with a commercially available three-eights inch drive air ratchet, used by the general public, for installing and removing a wide variety of sizes and kinds of fasteners where work and operating clearance is minimal; and stable one hand operation of the air ratchet/adaptor tool is needed. More specifically, this invention relates to said extensible adaptor in which provision is made for easy, rapid engagement/disengagement of internal sockets, of varying sizes, which do not protrude out of said adaptor beyond said socket's thin retainer flange, thereby keeping work space to a minimum.

2. Description of the Prior Art

In a repair or assembly shop, more specifically an automobile repair shop, where the three-eights inch drive air ratchet is in everyday use, there is a need and requirement for an extensible adaptor to said air ratchet which allows the mechanic to turn fasteners in limited work and operation space. Especially apparent is the need for a variety of sizes of internal removable sockets that utilize minimal work space. The following patents have made attempts to provide a tool for access to limited work space, but all have shortcomings with regard to simplicity and convenience.

U.S. Pat. Nos. 4,374,479 and 4,374,480 do not provide for adequate stability if used with said air ratchet; and both utilize the common protruding sockets, thereby taking up valuable work space. U.S. Pat. No. 4,287,795 is most suited for production lines in the automotive industry wherein the wrench is specifically used for one size fastener. Also U.S. Pat. No. 4,287,795 has an interconnection with the powered tool which is cumbersome and time consuming to attach, thereby limiting its usefulness to the general public.

U.S. Pat. No. 3,027,790 is designated as an adaptor for nuts, bolts, wrenches and the like. More specifically, its purpose is to provide a means to make the various sizes of American and Continental measuring systems interchangeable. More particularly, its split shell design cannot be used as a socket design.

U.S. Pat. No. 4,328,720 provides for a removable socket designed with means to permit engagement by a retention ring. The socket for larger size fasteners has a cylindrical socket end having straight sides which provides a weaker socket design than one with a bevelled surface when used with an air powered ratchet.

SUMMARY OF THE INVENTION

The present invention provides a tool which is adaptable to a commercially available three-eights inch drive, or other size, air ratchet for applying stablized powered torque to fasteners in relatively inaccessible work spaces. The present invention achieves its objectives by providing a handle means for attachment to said air ratchet which drives a gear train in an elongated housing terminating in a driven gear with means to use internal insertable type sockets and tips for a variety of sizes and kinds of fasteners.

It is thus the object of this invention to provide for a gear driven air ratchet adaptor comprising an elongated, flat housing and a handle means which may be simply and quickly attached to said air ratchet. Said air ratchet adaptor provides rigidity and stability when attached to said air ratchet, facilitating one hand operation of the tool.

Further objects include internal, easily engaged/-disengaged sockets for installing and removing fasteners in minimal work space, said sockets having an aperture allowing bolt or threaded shafts to pass through, also having check ball receptors for holding said sockets in place in the driven gear aperture, also having a radially outwardly extending flange on one end to keep it from sliding through the driven gear aperture, also having a radially inwardly extending flange on the opposite end to prevent the fastener head from passing completely through the socket, also having magnets (optional) attached on the upper flange to further facilitate the holding of metallic tips and nuts in order to maintain one hand operation of the tool, also having socket type adaptors for using a variety of screw driver tips, sockets, extensions, the common protruding sockets and such like.

A further object is to provide for a driven gear receptacle which receives the internal socket on either side of said housing thereby allowing for tool operation in multiple directions including the use of forward and reverse directions of the air ratchet.

A further object is to provide for inserts (not shown) for said air ratchet adaptor handle enabling said handle to fit many brands of commercially available air ratchets used by the general public.

A further object is to provide for an alternative elongated housing means (not shown) designed in a circular arc or hingedly adjustable without the loss of tool rigidity.

A further object is to provide for an alternative to said handle (not shown) wherein the air ratchet motor is made as an integral unit with said housing thereby eliminating the air ratchet head and said handle of said air ratchet adaptor while still providing two-way direction to the driven gear.

Further objects and advantages of the present invention will become apparent from a consideration of the drawings and ensuing description thereof.

DETAILED DESCRIPTION OF THE INVENTION

Figures 1, 2, 3, 4:
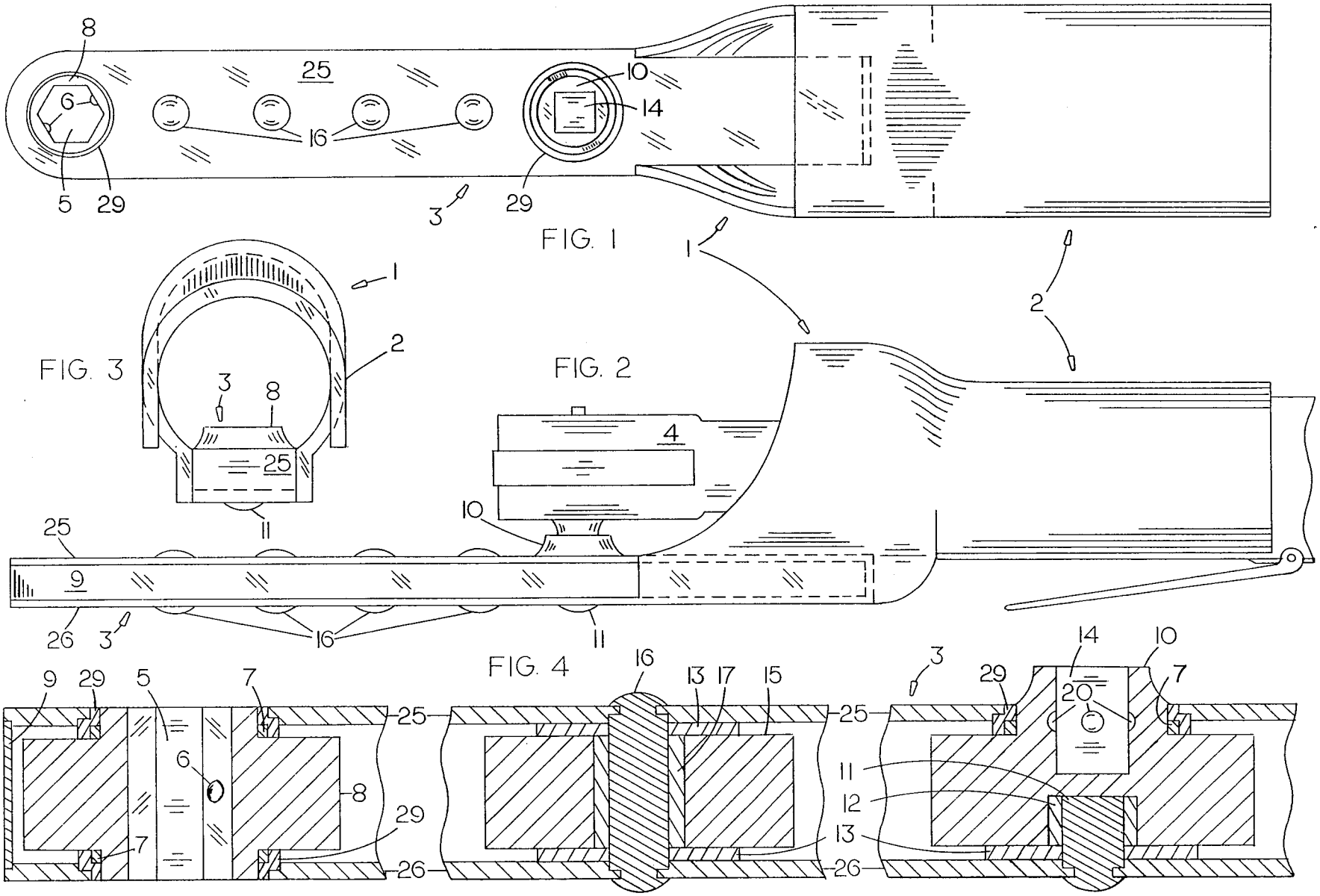
FIG. 1 is a top view of the air ratchet adaptor shown without an air ratchet installed so that the driven gear may be shown.
FIG. 2 is a side view of the air ratchet adaptor connected to a typical three-eights inch drive air ratchet which is broken away to conserve space.
FIG. 3 is an end view of the handle end of the air ratchet adaptor.
FIG. 4 is an enlarged, fragmented longitudinal cross sectional side view of the gears in the housing of the air ratchet adaptor.

Referring now to FIGS. 1 and 2, an air ratchet adaptor according to the present invention is generally designated by the reference numeral 1. The air ratchet adaptor 1 includes a slotted, semicylindrical handle 2 which serves as a holder of the commercially available three-eights inch drive air ratchet 4. Handle 2 is larger at the end attached to housing 3 to allow space for the air ratchet head to pass through the handle 2. The air ratchet head is slid through handle 2 and the air ratchet drive shaft is engaged with square aperture 14 of driving gear 10. A flat, elongated gear housing 3 is preferably fabricated with an upper plate 25 and a lower plate 26 enclosed by dust cover 9. Said dust cover 9 protects the gears from dirt and other abrasive materials. The upper plate 25 and lower plate 26 both define suitable aligned openings for support pins, bearings and the like which are contained within housing 3. Said upper plate 25 is a separate plate held in place by the support pins 16 and grooves on the inner walls of handle 2. Said lower plate 26 is formed as an integral unit with handle 2. Stationary support pins 16 provide support for the idler gears 15, while stationary support pin 11 provides support for the driving gear 10. Hexagonal aperture 5 of driven gear 8 contains two springloaded check balls 6 for holding the sockets 18 and 23 of FIG. 6 in place. A stepped race and dust seal 29 are situated around both the driven gear 8 and the driving gear 10.

Referring now to FIG. 3, an end view of the air ratchet adaptor 1 is shown from the perspective of the end of handle 2. The top of driven gear 8 and lower stationary support pin 11 are shown extending from housing 3. Also shown is the back of upper plate 25 connected to housing 3.

Figure 5:
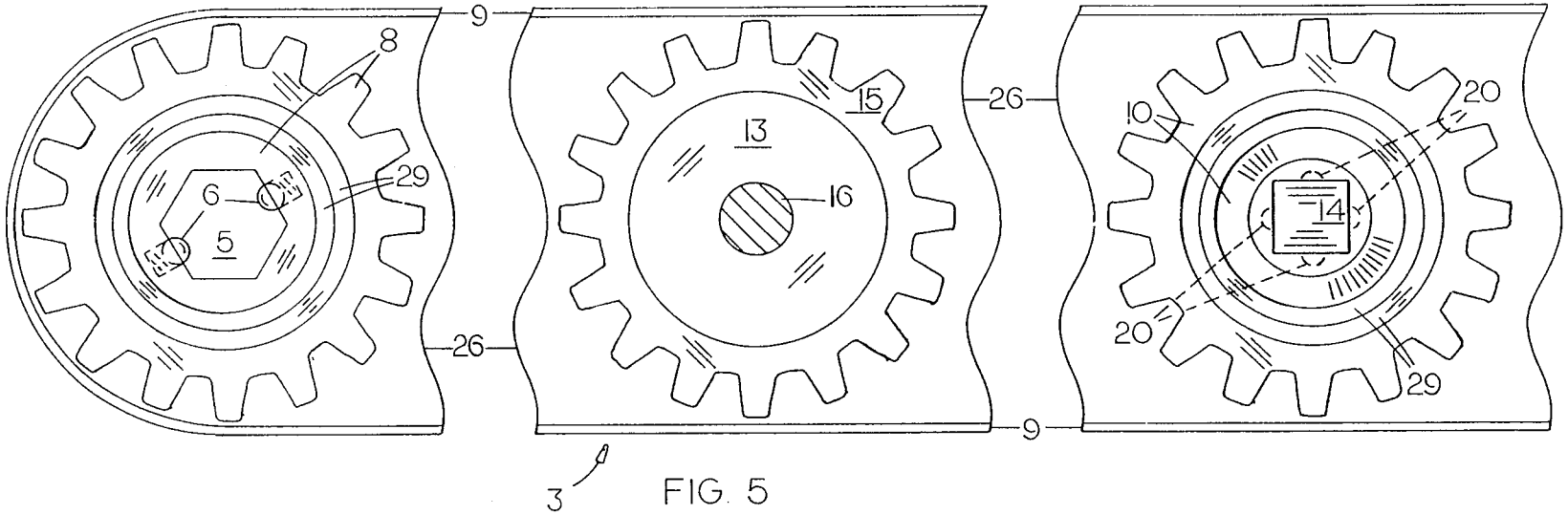
FIG. 5 is an enlarged, fragmented top view with the top plate removed exposing the gears in the housing of the air ratchet adaptor.

Referring now to FIGS. 4 and 5, the flat, elongated housing 3 is fragmented and enlarged to show the driving gear 10, idler gear 15, and driven gear 8 in detail. At one end of housing 3 and rotatably positioned in a pair of the said aligned openings in upper plate 25 and lower plate 26 is a driven gear 8. About the upper and lower periphery of driven gear 8 are disposed needle bearings 7 with stepped race and dust seal 29. Driven gear 8 includes an aperture 5 which preferably defines an internal hexagonal, flat surface for receiving internal sockets 18 and 23 of FIG. 6 which are examples of a socket set of varying sizes. On two of the just described surfaces are spring loaded check balls 6 for holding said sockets in place. The gear teeth of driven gear 8 mesh with the teeth of an adjacent idler gear 15. The idler gear 15 is disposed upon needle bearing 17 which is rotatably situated upon a stationary support pin 16. Upper and lower thrust washers 13 are situated between the idler gear 15 and the upper and lower plates 25 and 26. A series of idler gears 15 are driven by a driving gear 10 which has a square aperture 14 to receive the square shaft of air ratchet 4. Said aperture 14 having rounded recesses 20 on all four sides to receive the check ball of the air ratchet drive shaft. Driving gear 10 is situated upon an upper needle bearing 7 with stepped race and dust seal 29 and lower needle bearing 12. Lower needle bearing 12 is rotatably situated upon a stationary support pin 11. A lower thrust washer 13 is situated between the driving gear 10 and lower plate 26.

Figure 6:
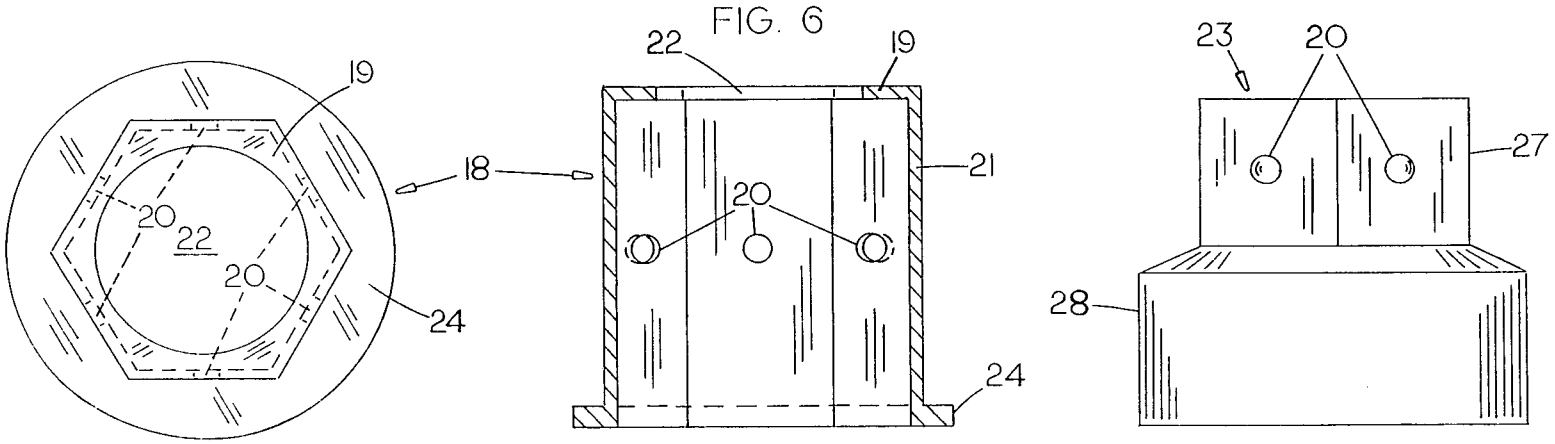
FIG. 6 is a top view, a cross sectional side view of a typical internal socket, and a side view of a typical internal/external socket for larger sized fasteners.

Referring now to FIG. 6, the internal socket 18 includes a top flange 19 extending radially inward to prevent a nut or bolt head from passing through the socket and a bottom flange 24 extending radially outward to prevent the socket from passing through the driven gear aperture 5. The side walls 21 of the socket 18 are provided on the outside as hexagonal, flat surfaces of which the outside diameter remains the same to fit in aperture 5 of driven gear 8. Said outside hexagonal surfaces having rounded recesses 20 to receive the check balls 6 of driven gear 8. Socket 18 as depicted in FIG. 6 illustrates a socket having the smallest thickness in the side wall 21, therefore the rounded recesses 20 are actually holes all the way through the side walls 21 to receive the spring loaded check balls 6 of driven gear 8. The side walls 21 of the socket 18 are provided on the inside as hexagonal, flat surfaces. Said inside hexagonal surfaces vary in diameter size for each socket in a socket set to provide for the variety of sizes for fasteners. Said inside surfaces may, of course, be made in twelve-point shape for engaging square nuts. Aperture 22 passes completely through the socket 18 and 23 to allow a threaded shaft to pass through said sockets. Sockets may be magnetized by the use of magnets (not shown) attached to the outside surface of flange 19. The socket 23 includes an upper shank 27 which has the same outside diameter as socket 18 for engaging with aperture 5 of driven gear 8, and rounded recesses 20 to receive the check balls 6 of driven gear 8. The lower periphery 28 of the socket 23 is extended radially outward, first with a bevelled surface, then in cylindrical fashion from the upper shank 27 to accommodate fasteners larger than aperture 5 will allow. The inner periphery of lower periphery 28 varies in diameter size for each socket in a socket set to provide for the variety of fastener sizes. An alternative to socket 23 is to make the driven end of housing 3 larger to accommodate a larger driven gear 8 with a larger aperture 5 to again receive larger internal sockets. The driven end of housing 3 may be enlarged by manufacturers as needed by consumers.

Operation and attachment of the air ratchet adaptor 1 is straightforward. The head of the air ratchet 4 is passed through handle 2 at the point where the enlarged end of handle 2 and housing 3 meet. The square drive shaft of air ratchet 4 is then inserted into aperture 14 of driving gear 10 while at the same time the air ratchet main body (motor housing) is inserted into handle 2 containing proper handle insert (not shown) of air ratchet adaptor 1. No tools are required for assembly or disassembly. The enlarged part of handle 2 provides space for the head of the air ratchet to pass through and also prevents the tool operator's hand from sliding off the tool during operation. The air ratchet supplies rotary power in either a forward or reverse direction to its driving shaft thereby rotating the driving gear 10. From the driving gear 10 power is transferred through the train of idler gears 15 to the driven gear 8. The size and number of said gear train may be varied to determine direction of rotation and vary torque and speed. Gears 8, 10, and 15 may be a dry type or lubricant may be packed within the sealed housing 3. Thrust washers 13 may be of an oil impregnated type. Needle bearings 7, 12, and 17 may be of the permanently lubricated and sealed type.

Sockets 18 and 23 may be slideably engaged into aperture 5 on either side of housing 3 providing a choice of up to four actual directions for turning fasteners while operating the air ratchet. Options for use in aperture 5 includes a hexagonal socket with a male square drive shaft to engage with the common protruding sockets, universal joint sockets, and extension shafts.

Another option includes a magnetized socket for a variety of tips, as straight blade screwdriver, phillips head, splined, and such like. Aperture 22 of sockets 18 and 23 eliminate the need for "deep sockets". The bevelled outer periphery of lower periphery 28 of socket 23 adds strength for use with air powered ratchets. Molded plastic type slotted, semi-cylindrical inserts (not shown) may be slideably placed into handle 2 thereby making said handle fit many different brands of air ratchets.

The air ratchet adaptor may be manufactured in different sizes to engage with the varying sizes of air ratchets and drives. The air ratchet adaptor housing may also be manufactured with either a circular arc housing or a hingedly adjustable, elongated housing (not shown).

It will be obvious to those skilled in the art that various changes may be made without departing from the spirit of the invention and the invention is not to be considered limited to what is shown in the drawings and described in the specifications.

What I claim is:

1. An air ratchet adaptor comprising:

a. a slotted, semicylindrical handle for interconnection with an air ratchet, b. a gear housing lower plate formed integrally on one end of said handle to provide rigidity and stability when said air ratchet and said air ratchet adaptor are assembled and operated, said gear housing lower plate includes a driven gear with means for engaging and rotating fasteners, a driving gear with means for receiving a drive shaft of said air ratchet, and intermediate idler gears extending between said driven and driving gears, said gears being rotatably mounted on support pins which are in engagement with aligned openings in said gear housing lower plate and an upper plate thus enabling the conveyance of torque to a fastener, said one end of said handle being enlarged to allow space in said handle for the head of said air ratchet during the mating process with said air ratchet adaptor, and for preventing the operator's hand from sliding off said air ratchet adaptor during operation.

* * * * *